US009932982B2

(12) United States Patent
Braasch

(10) Patent No.: US 9,932,982 B2
(45) Date of Patent: Apr. 3, 2018

(54) ROTARY PUMP WITH A COMPACT SETTING STRUCTURE FOR ADJUSTING THE DELIVERY VOLUME

(71) Applicant: Schwäbische Hüttenwerke Automotive GmbH, Aalen-Wasseralfingen (DE)

(72) Inventor: Holger Braasch, Pfullendorf (DE)

(73) Assignee: Schwäbische Hüttenwerke Automotive GmbH, Aalen-Wasseralfingen (DE)

( * ) Notice: Subject to any disclaimer, the term of this patent is extended or adjusted under 35 U.S.C. 154(b) by 95 days.

(21) Appl. No.: 14/958,035

(22) Filed: Dec. 3, 2015

(65) Prior Publication Data

US 2016/0177948 A1 Jun. 23, 2016

(30) Foreign Application Priority Data

Dec. 17, 2014 (DE) ..... 20 2014 106 121 U

(51) Int. Cl.

| | |
|---|---|
| ***F03C 4/00*** | (2006.01) |
| ***F04C 2/00*** | (2006.01) |
| ***F04C 14/18*** | (2006.01) |
| ***F04C 14/20*** | (2006.01) |
| ***F04C 2/344*** | (2006.01) |
| ***F04C 14/22*** | (2006.01) |
| ***F01C 21/10*** | (2006.01) |

(Continued)

(52) U.S. Cl.

CPC ..... *F04C 14/20* (2013.01); *F01C 21/10* (2013.01); *F01M 1/02* (2013.01); *F04C 2/344* (2013.01);

(Continued)

(58) Field of Classification Search

CPC ..... F04C 14/20; F04C 14/226; F04C 2/344; F04C 18/344; F04C 28/20; F01C 21/10;

(Continued)

(56) References Cited

U.S. PATENT DOCUMENTS

| | | | |
|---|---|---|---|
| 2,685,842 | A | 8/1954 | Hufferd |
| 8,814,544 | B2 | 8/2014 | Ebinger et al. |

(Continued)

FOREIGN PATENT DOCUMENTS

| | | | |
|---|---|---|---|
| CN | 101268279 | A | 9/2008 |
| CN | 103104484 | A | 5/2013 |

(Continued)

OTHER PUBLICATIONS

German Search Report issued in Application No. DE 20 2014 106 121.5 dated Jul. 10, 2015.

(Continued)

*Primary Examiner* — Theresa Trieu

(74) *Attorney, Agent, or Firm* — RatnerPrestia

(57) ABSTRACT

A rotary pump exhibiting an adjustable specific delivery volume, the rotary pump including a housing featuring a delivery chamber for a fluid feed; a delivery rotor in the delivery chamber; a setting structure which surrounds the delivery rotor, a spring exerting a spring force which acts on the setting structure in a first setting direction; a setting pressure chamber for applying a setting pressure of a setting fluid, which acts counter to the spring force in a second setting direction, to the setting structure; and a housing abutment, wherein the setting structure includes: a recess on a circumference; and a counter abutment for the housing abutment in the recess.

14 Claims, 1 Drawing Sheet

(51) Int. Cl.

| | |
|---|---|
| ***F01M 1/02*** | (2006.01) |
| ***F04C 18/344*** | (2006.01) |
| ***F04C 28/20*** | (2006.01) |
| *F04C 2/10* | (2006.01) |

(52) U.S. Cl.
CPC ..... *F04C 14/226* (2013.01); *F04C 18/344* (2013.01); *F04C 28/20* (2013.01); *F01M 2001/0238* (2013.01); *F01M 2001/0246* (2013.01); *F04C 2/10* (2013.01)

(58) Field of Classification Search
CPC ..... F01M 1/02; F01M 2001/0238; F01M 2001/0246
USPC ..... 418/24–27, 30, 259, 260; 417/218, 220
See application file for complete search history.

(56) References Cited

U.S. PATENT DOCUMENTS

| | | | |
|---|---|---|---|
| 2010/0008806 | A1 | 1/2010 | Koller et al. |
| 2013/0121867 | A1 | 5/2013 | Ebinger et al. |

FOREIGN PATENT DOCUMENTS

| | | | | |
|---|---|---|---|---|
| CN | 103711692 | A | 4/2014 | |
| DE | 10 2008 036 273 | A1 | 2/2010 | |
| DE | 10 2014 220 588 | A1 | 6/2015 | |
| EP | 0210786 | A1 * | 2/1987 | ..... F04C 14/226 |
| EP | 0 846 861 | A1 | 6/1998 | |
| EP | 2803859 | A1 * | 11/2014 | ..... F04C 14/226 |
| JP | 2012-132356 | A | 7/2012 | |
| JP | 2014-088784 | A | 5/2014 | |
| WO | 2007012096 | A2 | 2/2007 | |
| WO | WO 2014/111798 | A1 | 7/2014 | |

OTHER PUBLICATIONS

European Search Report issued in EP 15 20 0286 dated Apr. 7, 2016, 13 pages.
Chinese Office Action issued in CN 201510947070.2 dated Aug. 14, 2017, 21 pages.

* cited by examiner

ROTARY PUMP WITH A COMPACT SETTING STRUCTURE FOR ADJUSTING THE DELIVERY VOLUME

CROSS REFERENCE TO RELATED APPLICATIONS

This application claims priority to German Patent Application No. 20 2014 106 121.5, filed Dec. 17, 2014, the contents of such application being incorporated by reference herein.

FIELD OF THE INVENTION

The invention relates to a rotary pump comprising a delivery rotor and a setting structure which can be rotationally moved relative to a pump housing and the delivery rotor in order to adjust the specific delivery volume of the rotary pump.

BACKGROUND OF THE INVENTION

Rotary pumps such as the invention relates to are known for example from EP 0 846 861 B1 and U.S. Pat. No. 8,814,544 B2, which are incorporated by reference. These rotary pumps comprise a delivery rotor and a setting structure which surrounds the delivery rotor. The delivery rotor and the setting structure together form delivery cells in which a fluid is delivered from a low-pressure side to a high-pressure side of the pump. The setting structure can be moved relative to the pump housing and relative to the delivery rotor, such that an eccentricity between the delivery rotor and the setting structure and consequently a specific delivery volume of the rotary pump can be adjusted. For the adjustment, the spring force of a spring device acts on the setting structure and a fluid setting pressure acts on the setting structure counter to the spring force. The position of the setting structure is given by the equilibrium between the spring force and a setting pressure force generated by the setting pressure. The setting structures which can be rotationally moved comprise an appendage which projects on the outer circumference of the respective setting structure and on which the spring device is supported. The spring device therefore extends tangentially and laterally adjacent to the setting structure.

SUMMARY OF THE INVENTION

An aspect of the invention aims to reduce the design space and/or the weight of rotary pumps of the type described.

An aspect of the invention proceeds from a rotary pump, preferably a vane pump, which comprises a housing featuring: a delivery chamber; a delivery rotor which can be rotated about a rotational axis in the delivery chamber; and a setting structure which surrounds the delivery rotor. The delivery chamber can be bounded and therefore defined solely by the housing and setting structure. In principle, however, it is conceivable for the delivery chamber to be limited only once one or more other structures are added. The delivery rotor and the setting structure form delivery cells in which the fluid can be delivered, by rotating the delivery rotor, from an inlet which feeds into the delivery chamber to an outlet which feeds into the delivery chamber, in that the delivery cells increase in size on a low-pressure side of the delivery chamber and decrease in size again on a high-pressure side of the delivery chamber, as is known from internal toothed ring pumps and reciprocating piston valve pumps and in particular vane pumps. In order to be able to adjust the specific delivery volume, the setting structure can be moved rotationally back and forth relative to the delivery rotor and the housing, in a first setting direction and in a second setting direction counter to the first setting direction. The setting structure can be arranged such that it can be pivoted about a polar axis relative to the housing, in order to be able to adjust the specific delivery volume. It can be able to be pivoted about a non-stationary polar axis, for example roll off on a guiding curve, as is known from EP 0 846 861 B1. Preferably, however, the polar axis is a pivot axis which is stationary relative to the housing.

The delivery rotor comprises a rotor structure. The rotor structure can itself form the delivery rotor, which would consist of one part in such embodiments. The delivery rotor in internal toothed ring pumps, for example, is formed in one part. It is also conceivable in principle for a vane pump to comprise a delivery rotor which consists of one part, such that the terms "delivery rotor" and "rotor structure" can refer to the same part. A delivery rotor which is formed as a vane wheel which consists of one part can for example comprise elastically flexible vanes which yield in a dimensionally elastic and/or materially elastic way, in order to be able to form the delivery cells which increase in size and decrease again in size. More preferably, however, a delivery rotor formed as a vane wheel consists of multiple parts and comprises the rotor structure, which is a central rotor structure in such embodiments, and one or more vanes which project(s) outwards from the rotor structure and can (each) be moved in its/their entirety relative to the rotor structure. The vane or vanes can be connected to the rotor structure such that it/they can be rotationally moved. Preferably, however, the rotor structure mounts the one or more vanes such that it/they can (each) be slid translationally. The rotary pump can in particular be a vane cell pump. Preferred examples of single-vane and multi-vane rotary pumps are to be found in U.S. Pat. No. 8,814,544 B2 and DE 10 2008 036 273 B4, which is incorporated by reference, wherein the latter document only discloses a rotary pump which cannot be adjusted in terms of its specific delivery volume and which is only referred to because of the design of its delivery rotor.

In order to exert a spring force which acts on the setting structure in the first setting direction, the rotary pump comprises a spring device which is supported in a spring counter bearing of the setting structure. Also formed in the housing of the rotary pump is a setting pressure chamber for applying a setting pressure of a setting fluid, which acts counter to the spring force, to the setting structure. The setting pressure is preferably dependent on the delivery pressure generated by the rotary pump. The setting fluid can be a setting fluid which is separate from the fluid to be delivered by the rotary pump. Preferably, however, the setting pressure chamber is connected to a high-pressure side of the rotary pump, in that a connecting conduit branches off on the high-pressure side and feeds into the setting pressure chamber. The connection between the high-pressure side and the setting pressure chamber can be formed completely within the housing of the rotary pump. The setting fluid can however also be branched off on the high-pressure side downstream of the housing of the rotary pump and guided back into the setting pressure chamber. In such embodiments, the setting fluid is preferably branched off downstream of a fluid filter arranged on the high-pressure side, and upstream of an assembly to be supplied with the fluid. The position of the setting structure and therefore the specific delivery volume of the rotary pump is set by the equilibrium between the spring force and a setting pressure force generated by the setting fluid in the setting pressure chamber. In preferred embodiments, the circumference of the setting structure which faces radially away from the delivery rotor forms a chamber wall of the setting pressure chamber, such that the setting fluid acts directly on the setting structure.

In preferred embodiments, the spring counter bearing overlaps with the delivery rotor, in an axial view onto the delivery rotor, in an orthogonal direction with respect to the spring force and therefore also in relation to a straight line connecting the polar axis to the rotational axis of the delivery rotor. As compared to rotary pumps comprising a setting structure which can be rotationally moved, such as are known from the prior art, in which the spring device overlaps with the delivery rotor, in an axial view onto the delivery rotor, in the direction of the spring force and is therefore arranged laterally adjacent to the delivery rotor, orthogonally with respect to the spring force, the preferred arrangement of the spring counter bearing and the corresponding arrangement of the spring device reduces the width of the rotary pump as measured orthogonally with respect to the spring force. The lateral appendage on which the spring force acts in the known rotary pumps is omitted. In the rotary pump in accordance with the invention, the spring force acts on the setting structure with a shorter lever arm in relation to the polar axis. As viewed over its outer circumference, the setting structure can be more closely approximated to a compact circular shape than is possible with the conventional setting structures.

In advantageous embodiments, the spring device can be arranged on the low-pressure side of the rotary pump. It can thus extend at least predominantly over its length as measured in the direction of the spring force in an intake which in the pump housing connects an inlet of the housing to the inlet which feeds into the delivery chamber. In such embodiments, the intake is arranged on the side of the setting structure on which the spring counter bearing is also situated. The intake can in particular extend such that it channels the fluid at least substantially in the direction of the spring force to the inlet of the delivery chamber.

It is conducive to the compactness of the rotary pump if the spring force crosses the rotational axis of the delivery rotor, in the axial view onto the delivery rotor, within an inner circumference of the setting structure which surrounds the delivery rotor, i.e. if it extends in a linear elongation adjacent to the rotational axis of the delivery rotor at a distance and thereby forms a secant of the inner circumference of the setting structure. The spring counter bearing and the spring device can also be arranged such that the spring force intersects the rotational axis of the delivery rotor in a linear elongation. Expediently, however, the spring force crosses the rotational axis of the delivery rotor on a side which faces away from the polar axis of the setting structure.

It is advantageous if the spring counter bearing of the setting structure overlaps with the inlet of the delivery chamber, in the axial view onto the delivery rotor, orthogonally with respect to the spring force. The overlap is preferably such that the spring force points through the inlet in a linear elongation, in the axial view. The inlet of the delivery chamber can in particular extend in an end-facing surface of the housing which axially limits the delivery chamber. The outlet of the delivery chamber can likewise extend in an end-facing surface of the housing which axially limits the delivery chamber, preferably the same end-facing surface.

The ability of the setting structure to move can be limited in at least one of the two setting directions by a housing abutment which cannot be moved relative to the housing. More preferably, its ability to move is limited in both the first and second setting direction by an abutting contact.

The setting structure forms at least one counter abutment for the housing abutment. The at least one counter abutment can be a first counter abutment which passes into abutting contact with the housing abutment in the first setting direction and therefore limits the ability of the setting structure to move in the first setting direction. The at least one counter abutment can however instead also be a second counter abutment which passes into the abutting contact with the housing abutment in the second setting direction, i.e. counter to the spring force, in order to limit the ability of the setting structure to move in the second setting direction. In preferred embodiments, the setting structure comprises the first counter abutment and the second counter abutment.

In order to keep the width of the rotary pump—as measured in the axial view onto the delivery rotor, orthogonally with respect to the spring force—small, the setting structure can comprise a recess on its outer circumference which faces away from the delivery rotor, and the at least one counter abutment can be provided in the recess. If the setting structure comprises the first counter abutment and the second counter abutment, both counter abutments are preferably provided in the recess. The recess can border a circumferential region of the setting structure in the circumferential direction on one side, wherein the circumferential region of the setting structure forms a sealing gap with an inner circumferential region of the housing which faces opposite. The circumferential region of the setting structure which forms the sealing gap with the housing is expediently a circularly cylindrical planar region with a circular radius measured onto the polar axis. In order to better seal off the setting pressure chamber, a sealing element can be arranged in this circumferential planar region, for example accommodated in a cavity in the relevant circumferential region of the setting structure.

The housing abutment can protrude inwards from an inner circumference of the housing which faces the setting structure, into the recess of the setting structure. In preferred alternative embodiments, the housing abutment can project in the axial direction from an end-facing surface of the housing, which axially faces the setting structure, and protrude into the recess. The housing abutment can be directly moulded along with the housing as the latter is being originally moulded, or can be moulded separately from the housing and joined to it. Moulding it separately and joining it is particularly appropriate for embodiments in which the housing abutment projects from said end-facing surface of the housing and axially protrudes into the recess. In such embodiments, the housing abutment can be shaped as a bolt or pin and inserted into an axial recess and joined in the end-facing surface of the housing.

The housing can comprise a housing part, featuring a circumferential wall which surrounds the setting structure, and a cover which seals the circumferential wall on one end-facing side. The housing abutment can be provided on the cover or alternatively on the housing part which comprises the circumferential wall and can preferably project axially from an end-facing surface of the cover or said other housing part and protrude into the recess.

Forming the at least one counter abutment in a radial recess on the outer circumference of the setting structure is advantageous not only in combination with the arrangement of the spring counter bearing and delivery rotor overlapping in accordance with Aspect 1 described further below, but also in its own right, separate from the overlap in accordance with Aspect 1. While the feature of forming a first counter abutment and/or a second counter abutment in a radial recess on the circumference of the setting structure is particularly advantageous for a setting structure which can be rotationally moved, it is not however on the other hand restricted to the ability to perform a rotational setting movement. Realising this feature will also save design space in rotary pumps comprising a setting structure which performs a translational setting movement.

In preferred embodiments, the inlet and outlet of the delivery chamber are arranged such that the fluid delivered through the delivery chamber exerts a fluid pressure on the setting structure from within, on the high-pressure side of the delivery chamber which comprises the outlet, wherein the fluid pressure assists the spring force of the spring device. In such embodiments, the fluid pressure on the high-pressure side of the delivery chamber—this being the region of the delivery chamber in which the delivery cells decrease in size—acts counter to the setting pressure exerted on the setting structure by the setting fluid in the setting pressure chamber. This enables the spring force to be reduced and the spring device to be correspondingly decreased in size and/or configured to be more sensitive and/or softer.

The spring device is advantageously configured such that the spring force acts in the direction of a maximum specific delivery volume of the rotary pump. This is advantageous in particular when the setting pressure increases and decreases with the pressure on the high-pressure side of the rotary pump and is controlled or regulated by means of a control valve or regulating valve. If the spring force acts on the setting structure in the direction of maximum delivery, this imbues the rotary pump with a fail-safe feature.

The rotary pump can be a pump for delivering a gas, in particular air. It is more preferably a rotary pump for delivering a liquid, such as for example engine lubricating oil or transmission oil. One preferred area of application is vehicle manufacturing. The rotary pump can then in particular be a vacuum pump, engine lubricating oil pump or transmission oil pump of a motor vehicle. Preferably, the rotary pump is mechanically driven by a drive motor of the motor vehicle. In particular in applications in which the rotary pump is driven in a fixed rotational speed relationship by a drive motor of a motor vehicle, for example the crankshaft of an internal combustion engine of the motor vehicle, there is a need for the specific delivery volume to be adjustable in a controlled or regulated way. The delivery rotor can then be connected, such that it cannot be rotationally moved, to a crankshaft of an internal combustion engine, directly or via a transmission, for example a traction means gear system or a toothed wheel gear system. In simple embodiments, the rotary pump comprises one delivery rotor only. The rotary pump can however in principle also comprise two or even more delivery rotors, and the setting structure can surround multiple delivery rotors, or one setting structure can surround each of the delivery rotors respectively. If multiple setting structures are provided, at least one of these setting structures is formed in accordance with the invention with regard to the spring counter bearing.

Advantageous features are also described in the sub-claims and combinations of the sub-claims.

Features of the invention are also described in the aspects formulated below. The aspects are worded in the manner of claims and can be substituted for them. Features disclosed in the aspects can also supplement and/or qualify the claims, indicate alternatives to individual features and/or broaden features of claims. Bracketed reference signs refer to an example embodiment which is illustrated below in figures. They do not restrict the features described in the aspects to their literal sense as such, but do on the one hand indicate preferred ways of realising the respective feature.

Aspect 1. A rotary pump exhibiting an adjustable specific delivery volume, preferably a vane pump, said rotary pump comprising:

(a) a housing (1) featuring a delivery chamber (2) into which an inlet (3) and an outlet (4) for a fluid feed;

(b) a delivery rotor (10) which can be rotated about a rotational axis (R) in the delivery chamber (2);

(c) a setting structure (20) which surrounds the delivery rotor (10) and forms delivery cells (9) with the delivery rotor (10), in order to deliver the fluid from the inlet (3) to the outlet (4), and which can be rotationally moved in order to perform a setting movement, which adjusts the specific delivery volume of the rotary pump, relative to the delivery rotor (10) in a first setting direction and in a second setting direction counter to the first setting direction;

(d) a spring device (5) which is supported in a spring counter bearing (22) of the setting structure (20), in order to exert a spring force (F) which acts on the setting structure (20) in the first setting direction;

(e) and a setting pressure chamber (6) for applying a setting pressure of a setting fluid, which acts counter to the spring force (F), to the setting structure (20), (f) wherein the spring counter bearing (22) overlaps with the delivery rotor (10), in an axial view onto the delivery rotor (10), orthogonally with respect to the spring force (F).

Aspect 2. The rotary pump according to the preceding aspect, further comprising a housing abutment (8) which cannot be moved relative to the housing (1) and which limits a movement of the setting structure (20) in at least one of the setting directions by an abutting contact with the setting structure (20).

Aspect 3. The rotary pump according to the preceding aspect, wherein the setting structure (20) comprises: a radial recess (25) on a circumferential wall which faces away from the delivery rotor (10); and a counter abutment (26) in the recess (25), wherein the counter abutment (26) passes into abutting contact with the housing abutment (8) in the first setting direction.

Aspect 4. The rotary pump according to any one of the immediately preceding two aspects, wherein the setting structure (20) comprises: a radial recess (25) on a circumferential wall which faces away from the delivery rotor (10); and a counter abutment (27) in the recess (25), wherein the counter abutment (27) passes into abutting contact with the housing abutment (8) in the second setting direction.

Aspect 5. A rotary pump exhibiting an adjustable specific delivery volume, preferably a vane pump, said rotary pump comprising:

(a) a housing (1) featuring a delivery chamber (2) into which an inlet (3) and an outlet (4) for a fluid feed;

(b) a delivery rotor (10) which can be rotated about a rotational axis (R) in the delivery chamber (2);

(c) a setting structure (20) which surrounds the delivery rotor (10) and forms delivery cells (9) with the delivery rotor (10), in order to deliver the fluid from the inlet (3) to the outlet (4), and which can be moved, preferably rotationally moved, in order to perform a setting movement, which adjusts the specific delivery volume of the rotary pump, relative to the delivery rotor (10) in a first setting direction and in a second setting direction counter to the first setting direction;

(d) a spring device (5) which is supported in a spring counter bearing (22) of the setting structure (20), in order to exert a spring force (F) which acts on the setting structure (20) in the first setting direction;

(e) a setting pressure chamber (6) for applying a setting pressure of a setting fluid, which acts counter to the spring force (F), to the setting structure (20);

(f) and a housing abutment (8) which cannot be moved relative to the housing (1) and which limits a movement of the setting structure (20) in at least one of the setting directions by an abutting contact with the setting structure (20), (g) wherein the setting structure (20) comprises: a radial recess (25) on a circumferential wall which faces away from the delivery rotor (10); and a counter abutment (26) and/or a counter abutment (27) in the recess (25), wherein the counter abutment (26) passes into abutting contact with the housing abutment (8) in the first setting direction and/or the counter abutment (27) passes into abutting contact with the housing abutment (8) in the second setting direction.

Aspect 6. The rotary pump according to the preceding aspect, wherein the spring counter bearing (22) overlaps with the delivery rotor (10), in an axial view onto the delivery rotor (10), orthogonally with respect to the spring force (F).

Aspect 7. The rotary pump according to any one of the immediately preceding four aspects, wherein the counter abutment (26; 27) is formed by a wall of the recess (25) which is a trailing wall in relation to the setting movement which is limited by the abutting contact.

Aspect 8. The rotary pump according to the preceding aspect, wherein when the wall is in abutting contact, a region of the wall which forms the counter abutment (26; 27) encloses an angle of at most 40°, preferably at most 30°, with a tangential plane of the region of the wall which extends radially with respect to the rotational axis (R) of the delivery rotor (10) and/or a tangential plane of the region of the wall which extends radially with respect to a pivot axis of the setting structure (20).

Aspect 9. The rotary pump according to any one of Aspects 3 to 8, wherein the recess (25) is shaped as an axial groove on the circumference of the setting structure (20) which faces radially away from the delivery rotor (10).

Aspect 10. The rotary pump according to any one of Aspects 3 to 9, wherein the recess (25) is located on an outer circumference of the setting structure (20) and is open in the direction of an inner circumferential surface of the housing (1) which surrounds the setting structure (20).

Aspect 11. The rotary pump according to any one of Aspects 3 to 10, wherein the setting structure (20) forms a sealing gap (7) for the setting pressure chamber (6) with an inner circumferential surface of the housing (1), and the recess (25) borders the sealing gap (7) in the circumferential direction.

Aspect 12. The rotary pump according to the preceding aspect, wherein the recess (25) extends in the circumferential direction from the sealing gap (7) to another sealing gap which the setting structure (20) forms with the inner circumferential surface of the housing (1).

Aspect 13. The rotary pump according to any one of Aspects 3 to 12, wherein the recess (25) comprises a leading end and a trailing end in relation to the first setting direction, and an outer circumference of the setting structure (20) which lies opposite an inner circumferential surface of the housing (1) slopes, as viewed from the inner circumferential surface, at the leading end and at the trailing end, in order to form the recess (25).

Aspect 14. The rotary pump according to any one of the preceding aspects, wherein a length of the recess (25), as measured in the circumferential direction of the setting structure (20) from the leading end to the trailing end, is sufficiently small that a straight line placed onto the setting structure (20) covers the recess (25) over its entire length.

Aspect 15. The rotary pump according to any one of Aspects 3 to 14, wherein the setting structure (20) comprises the counter abutment (26) in the recess (25), wherein the counter abutment (26) passes into abutting contact with the housing abutment (8), which protrudes into the recess, in the first setting direction, and wherein the setting structure (20) comprises a counter abutment (27) in the recess (25), wherein the counter abutment (27) passes into abutting contact with the housing abutment (8), which protrudes into the recess, or with another housing abutment which protrudes into the recess, in the second setting direction.

Aspect 16. The rotary pump according to any one of Aspects 2 to 15, wherein the housing abutment (8) projects axially from an end-facing surface of the housing (1), which faces the setting structure (20), preferably in the shape of a pin or bolt.

Aspect 17. The rotary pump according to any one of the preceding aspects, wherein the spring force (F) crosses or intersects the rotational axis (R) of the delivery rotor (10), in an axial view onto the delivery rotor (10), within an inner circumference of the setting structure (20) which faces the delivery rotor (10).

Aspect 18. The rotary pump according to any one of the preceding aspects, wherein the spring device (5) comprises a spring member, preferably a helical pressure spring, which acts on the setting structure (20) in the direction of the delivery chamber (2) and eccentrically with respect to the rotational axis (R) of the delivery rotor (10).

Aspect 19. The rotary pump according to any one of the preceding aspects, wherein the spring device (5) does not exhibit an overlap with the delivery rotor (10) parallel to the spring force (F).

Aspect 20. The rotary pump according to any one of the preceding aspects, wherein the setting structure (20) can be moved rotationally, preferably pivoted, back and forth about a polar axis (P), preferably a pivot axis which is stationary relative to the housing (1), in the first setting direction and the second setting direction.

Aspect 21. The rotary pump according to the preceding aspect, wherein the spring force (F) crosses the rotational axis (R) of the delivery rotor (10) on a side which faces away from the polar axis (P).

Aspect 22. The rotary pump according to any one of the preceding aspects, wherein the setting structure (20) can be pivoted back and forth relative to the housing (1) in a rotary joint (1, 20) about a pivot axis (P), which is stationary relative to the housing (1), in the first setting direction and the second setting direction.

Aspect 23. The rotary pump according to the preceding aspect, wherein the setting structure (20) and the housing (1) each directly form one joint element of the rotary joint (1, 20).

Aspect 24. The rotary pump according to any one of the preceding two aspects, wherein an outer circumference of the setting structure (20) which faces away from the delivery rotor (10) comprises a bearing surface (21), and the setting structure (20) is in a sliding contact with a facing inner circumferential surface of the housing (1) in the region of the bearing surface (21), wherein the setting structure (20) and the housing (1) together form the rotary joint (1, 20) in said sliding contact.

Aspect 25. The rotary pump according to any one of the preceding aspects, wherein the spring counter bearing (22) overlaps with the inlet (3) of the delivery chamber (2), in an axial view onto the delivery rotor (10), orthogonally with respect to the spring force (F).

Aspect 26. The rotary pump according to any one of the preceding aspects, wherein the housing (1) comprises: an inlet into the housing (1) for the fluid to be delivered; and an intake (9) which connects the inlet into the housing (1) to the inlet (3) of the delivery chamber (2) and overlaps with the delivery rotor (10), in an axial view onto the delivery rotor (10), orthogonally with respect to the spring force (F), and wherein the spring device (5) extends in the intake (9).

Aspect 27. The rotary pump according to the preceding aspect, wherein the intake (9) channels the fluid in the direction of the spring force (F) in the region of the spring device (5).

Aspect 28. The rotary pump according to any one of the preceding two aspects, wherein the intake (9) channels the fluid in the direction of the spring force (F) into the inlet (3) of the delivery chamber (2).

Aspect 29. The rotary pump according to any one of the preceding aspects, wherein the rotary pump is used to supply an assembly of a motor vehicle with the fluid and is driven in a fixed rotational speed relationship by a drive motor of the vehicle.

Aspect 30. The rotary pump according to any one of the preceding aspects, wherein the rotary pump is a vacuum pump or in particular an engine lubricating oil pump or transmission oil pump of an internal combustion drive engine of a motor vehicle.

Aspect 31. The rotary pump according to any one of the preceding aspects, wherein the effective direction of the spring force (F), in an axial view onto the delivery rotor (10), extends between the rotational axis (R) of the delivery rotor (10) and the recess (25).

Aspect 32. The rotary pump according to any one of the preceding aspects, wherein the effective direction of the spring force (F), in an axial view onto the delivery rotor (10), extends between a polar axis (P) of the setting structure (20) and the recess (25).

Aspect 33. The rotary pump according to any one of the preceding aspects, wherein a connecting straight line, which in an axial view onto the delivery rotor (10) intersects the rotational axis (R) of the delivery rotor (10) and extends through the recess (25), points orthogonally with respect to the spring force (F).

Aspect 34. The rotary pump according to any one of the preceding aspects, wherein a connecting straight line, which in an axial view onto the delivery rotor (10) intersects a polar axis (P) of the setting structure (20) and preferably the rotational axis (R) of the delivery rotor (10) and extends through the recess (25), points orthogonally with respect to the spring force (F).

Aspect 35. The rotary pump according to any one of the preceding aspects, wherein a connecting straight line, which in an axial view onto the delivery rotor (10) connects the rotational axis (R) of the delivery rotor (10) and a polar axis (P) of the setting structure (20), extends through the recess (25) which is arranged on the circumference of the setting structure (20).

Aspect 36. The rotary pump according to any one of the preceding aspects, wherein the effective direction of the spring force (F) extends through the setting pressure chamber (6).

BRIEF DESCRIPTION OF THE DRAWINGS

An example embodiment of the invention is described below on the basis of figures. Features disclosed by the example embodiment, each individually and in any combination of features, advantageously develop the subject-matter of the claims and the aspects and embodiments described above. There is shown:

DETAILED DESCRIPTION OF THE INVENTION

Figure 1:
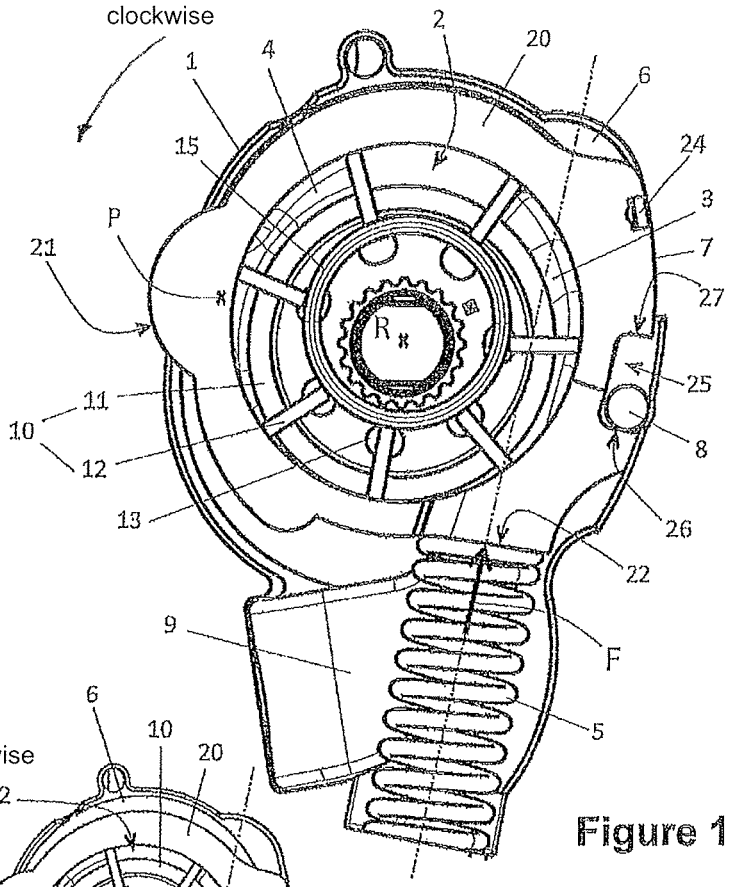
FIG. 1 a rotary pump comprising a setting structure which can be rotationally moved, in a position for a maximum delivery volume.

FIG. 1 shows a rotary pump in a vane cell design by way of example. The rotary pump is shown in an axial view onto a delivery rotor 10 of the pump. The pump comprises a housing 1, of which only a housing part is shown in FIG. 1, which surrounds a delivery chamber 2, in which the delivery rotor 10 is arranged such that it can be rotated about a rotational axis R, and a setting structure 20. The housing part also comprises an end-facing wall of the housing 1 which axially faces the delivery rotor 10 and can be seen behind the delivery rotor 10 in FIG. 1. Only a radially inner edge of a circumferential wall of the housing part is shown. A cover of the housing 1 has been removed, such that the functional components of the rotary pump can be seen. The delivery chamber 2 comprises an inlet 3 and an outlet 4 for a fluid to be delivered, for example engine lubricating oil. The delivery chamber 2 comprises a low-pressure side and a high-pressure side. When the delivery rotor 10 is rotary-driven, anticlockwise in FIG. 1, fluid flows through the inlet 3 on the low-pressure side into the delivery chamber 2 and is expelled at an increased pressure on the high-pressure side and discharged through the outlet 4.

The delivery rotor 10 is a vane wheel comprising a rotor structure 11, which is central with respect to the rotational axis R, and vanes 12 which are arranged in a distribution over the circumference of the rotor structure 11. The vanes 12 are guided in slots 13 of the rotor structure 11, which are open towards the outer circumference of the rotor structure 11, such that the vanes 12 can be shifted, sliding, in a radial or at least substantially radial direction. They are supported radially on the inside of a supporting structure 15. The supporting structure 15 can be moved relative to the rotor structure 11, in order to be able to equalise setting movements of the setting structure 20.

The outer circumference of the delivery rotor 10 is surrounded by the setting structure 20. When the delivery rotor 10 is rotary-driven, its vanes 12 slide over an inner circumferential surface of the setting structure 20. The rotational axis R of the delivery rotor 10 is arranged eccentrically with respect to a parallel central axis of the setting structure 20, such that when the delivery rotor 10 is rotated, delivery cells formed by the delivery rotor 10 and the setting structure 20 increase in size in the rotational direction on the low-pressure side of the delivery chamber 2 and decrease in size again on the high-pressure side. Due to this increase and decrease in the size of the delivery cells, which is periodic with the rotational speed of the delivery rotor 10, the fluid is delivered from the low-pressure side to the high-pressure side, where it is delivered at an increased pressure through the outlet 4.

The volume of fluid which is delivered by each revolution of the delivery rotor 10, the so-called specific delivery volume, can be adjusted. If the fluid is a liquid and therefore—in a good approximation—incompressible, the absolute delivery volume is directly proportional to the rotational speed of the delivery rotor 10. In the case of compressible fluids, for example air, the relationship between the delivered amount and the rotational speed may not be linear, but the absolute delivered amount and/or mass likewise increases with the rotational speed.

The specific delivery volume depends on the eccentricity, i.e. the distance between the central axis of the setting structure 20 and the rotational axis R of the delivery rotor 10. In order to be able to change this axial distance, the setting structure 20 is arranged such that it can be rotationally moved in the housing 1, for example such that it can be pivoted about a polar axis P and/or pivot axis which is stationary relative to the housing 1. In variations, a modified setting structure can also be arranged such that it can be pivoted about a non-stationary polar axis in the housing 1.

A pivot bearing region of the setting structure 20 is indicated by 21. The pivot bearing is embodied as a slide bearing, in that the pivot bearing region 21 of the setting structure 20 is in direct sliding contact with a co-operating surface of the housing 1. The housing 1 comprises a housing part (not shown) which surrounds the setting structure 20 on the outside and forms the co-operating surface of the housing 1. The cover of the housing 1 which can be seen in FIG. 1 seals off this other housing part on an axial end-facing side.

A spring force F is applied to the setting structure 20 in a first setting direction. The spring force F is generated by a spring device 5 comprising one or more mechanical spring members—in the example embodiment, one spring member. The spring member is embodied and arranged as a helical pressure spring. A setting pressure of a setting fluid is applied to the setting structure 20 in a second setting direction counter to the first setting direction. For applying pressure using the setting fluid, a setting pressure chamber 6 is formed on the outer circumference of the setting structure 20, opposite the spring device 5 across the rotational axis R, wherein the setting fluid can be introduced into the setting pressure chamber 6 by the setting pressure which is dependent on the pressure of the high-pressure side of the rotary pump. The setting structure 20 forms a chamber wall of the setting pressure chamber 6. The setting pressure which acts on this chamber wall generates a fluid setting force which acts counter to the spring force F. The setting structure 20 assumes a pivoting position which corresponds to the current equilibrium between the spring force F and the fluid setting force. In FIG. 1, the setting structure 20 assumes the position which corresponds to the maximum specific delivery volume, i.e. the eccentricity of the central longitudinal axis of the setting structure 20 with respect to the rotational axis R of the delivery rotor 10 is at a maximum.

The setting pressure chamber 6 is fed with the pressure fluid delivered by the rotary pump, in order to apply the setting pressure to the setting structure 20 in the second setting direction. The second setting direction is selected such that the eccentricity between the delivery rotor 10 and the setting structure 20 and therefore the specific delivery volume decreases in size when the setting structure 20 is moved in the second setting direction.

Figure 2:
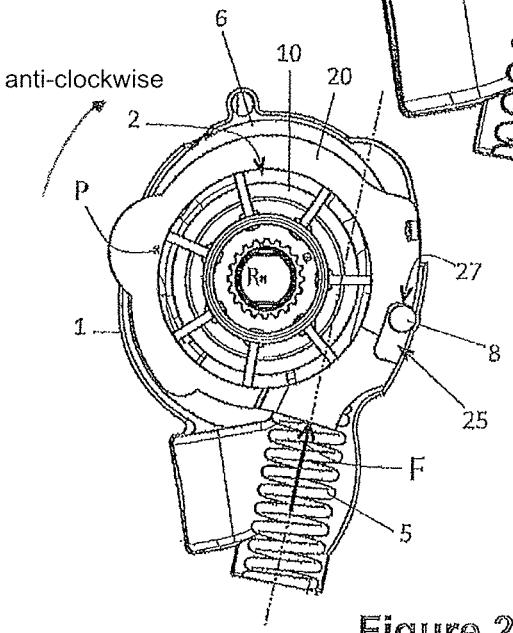
FIG. 2 the rotary pump comprising the setting structure, in a position for a minimum delivery volume.

FIG. 2 shows the setting structure 20 in a position for a minimum specific delivery volume. In the example embodiment, the proportions have been selected such that when the setting structure 20 is in this position, the central longitudinal axis of the setting structure 20 coincides with the rotational axis R of the delivery rotor 10, and the rotary pump does not deliver any fluid since the volume of the delivery cells does not change when the delivery rotor 10 is rotated.

The setting structure 20 and a circumferential wall of the housing 1 (not shown) together form a radial sealing gap 7 which extends in the circumferential direction and separates the setting pressure chamber 6 from the low-pressure region of the housing 1 in the second setting direction. A sealing element 24 is arranged in the radial sealing gap 7 in order to better seal off the sealing gap 7. The sealing element 24 can be arranged in a receptacle of the setting structure 20.

In relation to controlling or regulating the delivery volume by applying the setting pressure as described, reference is made to U.S. Pat. No. 8,814,544 B2, which is incorporated by reference in this respect and also with respect to other details of the functionality of the rotary pump.

Unlike the known rotary pumps, however, the spring device 5 is not arranged laterally adjacent to the delivery rotor 10 and the delivery chamber 2, as viewed from the polar axis P across the rotational axis R. The spring force F crosses the rotational axis R on the side which faces away from the polar axis P, at a smaller distance than in the known rotary pumps. This reduces the width of the rotary pump as measured parallel to a connecting straight line between the polar axis P and the rotational axis R.

The spring device 5 acts on the setting structure 20 in a spring counter bearing 22 which is formed by the setting structure 20 and which overlaps with the delivery rotor 10 and the delivery chamber 2, in an axial view onto the delivery rotor 10, in relation to a direction which points orthogonally with respect to the spring force F. The spring force F crosses the rotational axis R, in the axial view, within the inner circumference of the setting structure 20 which radially faces the delivery rotor 10 and, as is preferred, even within an outer circumference of the central rotor structure 11. Due to the spring counter bearing 22 being arranged such that it overlaps transverse to the spring force F, and the spring force F being introduced with shortened leverage, the setting structure 20 can be more closely approximated to a radially compact annular shape than the setting structures known from the prior art, comprising a radially projecting appendage for introducing the spring force, allow.

The position for a maximum delivery volume (FIG. 1) and the position for a minimum delivery volume (FIG. 2) are each predetermined by an abutting contact between the setting structure 20 and a housing abutment 8 which cannot be moved relative to the housing 1. In order to keep the setting structure 20 radially compact, a first counter abutment 26 and a second counter abutment 27 for the housing abutment 8 are provided in a recess 25 which is formed on the outer circumference of the setting structure 20. The housing abutment 8 protrudes into the recess 25. The counter abutments 26 and 27 are formed by a side wall of the recess 25 each. If the torque generated by the spring force F about the polar axis P exceeds the torque generated by the setting pressure about the polar axis P, the setting structure 20 pivots in the first setting direction, anticlockwise in the figures, until the first counter abutment 26, which is a trailing counter abutment in relation to the first setting direction, passes into abutting contact with the housing abutment 8 in the first setting direction. In FIG. 1, this abutting contact has been established. If the torque generated by the setting pressure exceeds the torque generated by the spring force F, the setting structure 20 pivots in the second setting direction, clockwise in the figures, until the setting structure 20 comprising the second counter abutment 27, which is a trailing counter abutment in relation to the second setting direction, passes into abutting contact with the housing abutment 8. This state is shown in FIG. 2.

The housing abutment 8 can be shaped as a cam which projects radially from an inner circumferential surface of the housing 1 into the recess 25. In order to be able to mould the circumferential contour of the housing 1 as simply as possible, for example using casting moulds, the housing abutment 8 can however be formed, as in the example embodiment, as a pin or bolt which projects from an end-facing surface of the housing 1 which axially faces the setting structure 20. When formed in this way, the housing abutment 8 can in particular, as in the example embodiment, project from a housing part which surrounds the setting structure 20 or from a cover of the housing 1. If the housing abutment 8 projects from a cover of the housing 1, a housing part which surrounds the setting structure 20 at its circumference can be simplified.

The spring device 5 is arranged in a space-saving way in an intake 9 which connects a fluid inlet of the housing 1 to the inlet 3 which feeds into the delivery chamber 2. It is favourable if the spring force F forms, in a linear elongation as shown, a secant of the reniform inlet 3 which is curved in accordance with the inner circumference of the setting structure 20. The intake 9 can extend in the housing 1 towards the inlet 3 in the direction of the spring force F along the spring device 5, in order to reduce the flow resistance between the inlet into the housing 1 and the inlet 3 which feeds into the delivery chamber 2 and to fill the delivery chamber 2 particularly uniformly on the low-pressure side. The intake 9 can in particular extend in a spiral from the inlet into the housing 1, into the inlet 3.

REFERENCE SIGNS

1 housing
2 delivery chamber
3 inlet
4 outlet
5 spring device
6 setting pressure chamber
7 sealing gap
8 housing abutment
9 intake
10 delivery rotor
11 rotor structure
12 vane
13 slot
14 —
15 supporting structure
16 —
17 —
18 —
19 —
20 setting structure
21 pivot bearing region, bearing surface
22 spring counter bearing
23 —
24 sealing element
25 recess
26 counter abutment
27 counter abutment
F spring force
P polar axis, pivot axis
R rotational axis

The invention claimed is:

1. A rotary pump exhibiting an adjustable specific delivery volume said rotary pump comprising:

(a) a housing featuring a delivery chamber into which an inlet and an outlet for a fluid feed;

(b) a delivery rotor which is rotated about a rotational axis in the delivery chamber in order to deliver fluid from the inlet to the outlet;

(c) a setting ring which surrounds the delivery rotor and forms delivery cells with the delivery rotor, in order to deliver the fluid from the inlet to the outlet, and which is pivoted in order to perform a setting movement, which adjusts the specific delivery volume of the rotary pump, relative to the delivery rotor in a first setting direction and in a second setting direction counter to the first setting direction;

(d) a spring device which is supported in a spring counter bearing of the setting structure, in order to exert a spring force which acts on the setting structure in the first setting direction;

(e) a setting pressure chamber for applying a setting pressure of a setting fluid, which acts counter to the spring force, to the setting structure;

(f) and a housing abutment rigidly coupled to the housing and which limits a movement of the setting ring in at least one of the setting directions by an abutting contact with the setting ring, (g) wherein the setting ring comprises: a radial recess on a circumferential wall which faces away from the delivery rotor; and a counter abutment or a first counter abutment and a second counter abutment in the recess, wherein the counter abutment or the first counter abutment passes into abutting contact with the housing abutment in the first setting direction and the second counter abutment passes into abutting contact with the housing abutment in the second setting direction, wherein (h) the housing comprises: an inlet into the housing for the fluid to be delivered; and an intake which connects the inlet into the housing to the inlet of the delivery chamber and overlaps with the delivery rotor, in an axial view onto the delivery rotor, orthogonally with respect to the spring force, and wherein the spring device extends in the intake and the inlet channels the fluid in the direction of the spring force to the inlet of the delivery chamber.

2. The rotary pump according to claim 1, wherein the spring counter bearing overlaps with the delivery rotor, in an axial view onto the delivery rotor, orthogonally with respect to the spring force.

3. The rotary pump according to claim 1, wherein the counter abutment or the first counter abutment and the second counter abutment is formed by a wall of the recess which is a trailing wall in relation to the setting movement which is limited by the abutting contact.

4. The rotary pump according to claim 3, wherein when the wall is in abutting contact, a region of the wall which forms the counter abutment, the first counter abutment or the second counter abutment encloses an angle of at most 40°, or at most 30°, with a tangential plane of the region of the wall which extends radially with respect to the rotational axis of the delivery rotor.

5. The rotary pump according to claim 3, wherein when the wall is in abutting contact, a region of the wall which forms the counter abutment, the first counter abutment or the second counter abutment encloses an angle of at most 40°, or at most 30°, with a tangential plane of the region of the wall which extends radially with respect to a pivot axis of the setting ring.

6. The rotary pump according to claim 1, wherein the recess is shaped as an axial groove on the circumference of the setting ring which faces radially away from the delivery rotor.

7. The rotary pump according to claim 1, wherein the housing abutment projects axially from an end-facing surface of the housing, which faces the setting ring.

8. The rotary pump according to claim 1, wherein the setting ring forms a sealing gap for the setting pressure chamber with an inner circumferential surface of the housing, and the recess borders the sealing gap in the circumferential direction.

9. The rotary pump according to claim 1, wherein a length of the recess, as measured in the circumferential direction of the setting structure from the first counter abutment to the second counter abutment, is sufficiently small that a straight line placed onto the setting ring covers the recess over its entire length.

10. The rotary pump according to claim 1, wherein at least one of:

the spring device comprises a spring member which acts on the setting ring in the direction of the delivery chamber and eccentrically with respect to the rotational axis of the delivery rotor;

the spring force crosses the rotational axis of the delivery rotor, in an axial view onto the delivery rotor, within an inner circumference of the setting structure which faces the delivery rotor;

the spring force crosses the rotational axis of the delivery rotor on a side which faces away from the pivot axis of the setting ring; and the spring device does not exhibit an overlap with the delivery rotor parallel to the spring force.

11. The rotary pump according to claim 1, wherein the setting ring is pivoted, back and forth about the pivot axis which is stationary relative to the housing, in the first setting direction and the second setting direction.

12. The rotary pump according to claim 1, wherein the setting ring is pivoted back and forth relative to the housing in a rotary joint about a pivot axis, which is stationary relative to the housing, in the first setting direction and the second setting direction.

13. The rotary pump according to claim 1, wherein the spring counter bearing overlaps with the inlet of the delivery chamber, in an axial view onto the delivery rotor, orthogonally with respect to the spring force.

14. The rotary pump according to claim 1, wherein the rotary pump is used to supply an assembly of a motor vehicle with the fluid and is driven in a fixed rotational speed relationship by a drive motor of the vehicle, and wherein the rotary pump is a vacuum pump or an engine lubricating oil pump or transmission oil pump or a transmission oil pump of the motor vehicle.

* * * * *